US008621758B2

(12) United States Patent
Quintiliani et al.

(10) Patent No.: US 8,621,758 B2
(45) Date of Patent: Jan. 7, 2014

(54) RAZOR HANDLE

(71) Applicants: Robert Quintiliani, West Yarmouth, MA (US); Frank Renaldi, Seymour, CT (US); Nathan Venskytis, Hamden, CT (US)

(72) Inventors: Robert Quintiliani, West Yarmouth, MA (US); Frank Renaldi, Seymour, CT (US); Nathan Venskytis, Hamden, CT (US)

( * ) Notice: Subject to any disclaimer, the term of this patent is extended or adjusted under 35 U.S.C. 154(b) by 0 days.

(21) Appl. No.: 13/767,246

(22) Filed: Feb. 14, 2013

(65) Prior Publication Data

US 2013/0152408 A1 Jun. 20, 2013

Related U.S. Application Data

(63) Continuation of application No. 12/020,658, filed on Jan. 28, 2008, now Pat. No. 8,424,215.

(60) Provisional application No. 60/899,185, filed on Feb. 1, 2007.

(51) Int. Cl.
*B26B 21/00* (2006.01)

(52) U.S. Cl.
USPC ..... 30/526; 30/32

(58) Field of Classification Search
USPC ..... 30/526, 32; 16/431, 436; 15/143.1
See application file for complete search history.

(56) References Cited

U.S. PATENT DOCUMENTS 4,281,455 A * 8/1981 Dixon et al. ..... 30/47
4,658,505 A * 4/1987 Williams ..... 30/47
4,801,232 A * 1/1989 Hempel ..... 411/552
4,841,638 A * 6/1989 Bardeen et al. ..... 30/332
5,027,511 A 7/1991 Miller
5,309,596 A * 5/1994 Simms ..... 15/167.1
5,784,790 A * 7/1998 Carson et al. ..... 30/532
5,794,349 A * 8/1998 Kelley et al. ..... 30/279.6
5,822,869 A 10/1998 Metcalf et al.
5,890,296 A * 4/1999 Metcalf et al. ..... 30/526
5,899,824 A * 5/1999 Kurtz et al. ..... 473/578
5,918,369 A * 7/1999 Apprille et al. ..... 30/47
6,029,354 A * 2/2000 Apprille et al. ..... 30/47
6,108,869 A 8/2000 Meessmann et al.
6,116,807 A 9/2000 Dzurko et al.
6,164,290 A 12/2000 Andrews
6,393,704 B1 5/2002 Tompkins et al.
6,886,262 B2 * 5/2005 Ohtsubo et al. ..... 30/526
7,114,217 B2 * 10/2006 Matsuzawa et al. ..... 16/2.2
7,197,825 B2 * 4/2007 Walker et al. ..... 30/77
7,497,487 B2 * 3/2009 Burmahln ..... 292/200
7,736,107 B2 * 6/2010 Okada ..... 411/41
7,740,432 B2 * 6/2010 Harada ..... 411/45
8,424,215 B2 * 4/2013 Quintiliani et al. ..... 30/526

(Continued)

*Primary Examiner* — Ghassem Alie
*Assistant Examiner* — Bharat C Patel
(74) *Attorney, Agent, or Firm* — Energizer Personal Care, LLC

(57) ABSTRACT

A handle for a safety razor is provided that includes an elongated hand gripping structure with a cartridge support structure at an end of the hand gripping structure. The hand gripping structure includes a frame and a first and second gripping pad. Each gripping pad can have a thermoplastic elastomeric gripping layer and a nonelastomeric thermoplastic support layer. The first gripping pad has an extension that cooperates with an opening of the frame to provide a snap fit joint between the frame and the first gripping pad. The second gripping pad has an extension that cooperates with the extension of the first gripping pad to prevent disengagement of the snap fit from the opening of the frame. The extension of the first gripping pad can be bifurcated and the extension of the second gripping pad can be received in the bifurcation.

6 Claims, 3 Drawing Sheets

(56) References Cited

U.S. PATENT DOCUMENTS

2003/0046780 A1* 3/2003 Davis ..... 15/167.1
2003/0172498 A1 9/2003 Polzin et al.
2004/0103545 A1 6/2004 Dansreau
2005/0019130 A1* 1/2005 Kanie et al. ..... 411/45
2006/0272154 A1* 12/2006 Brevard ..... 30/41
2007/0039151 A1* 2/2007 Crawley ..... 29/401.1

* cited by examiner

RAZOR HANDLE

CROSS REFERENCE TO RELATED APPLICATIONS

This application is a continuation of U.S. patent application Ser. No. 12/020,658, filed Jan. 28, 2008 which claims the benefit of U.S. provisional patent application Ser. No. 60/899,185, filed Feb. 1, 2007, the subject matter of both being incorporated by reference herein in their entireties.

BACKGROUND OF THE INVENTION

1. Technical Field

This invention relates generally to wet shaving devices, and more specifically to razor handles including hand gripping pads.

2. Background Information

Many modern safety razors include a disposable razor cartridge adapted to be selectively connected to a reusable handle by cartridge support structure therebetween. The cartridge includes a housing having at least one razor blade with a sharpened cutting edge disposed therein. The handle can be provided with gripping pads having on their exterior surfaces an elastomeric, ie rubber-like material. A normal wet shaving operation is typically performed in an environment that can cause a razor handle to be wet and/or slippery due to the shaving soaps or other preparations employed by the user. The elastomeric material provides the user with at least a sense of a more secure grip of the handle in these circumstances and can help prevent nicks and cuts that might be caused by the user mishandling the razor or can help prevent the user accidentally dropping the razor.

Exemplary razors with elastomeric gripping pads are disclosed in U.S. Pat. Nos. 5,822,869 and 5,890,296, both to Metcalf et al. These Patents disclose razor handles having elongated hand-gripping structures that include a frame and at least two gripping pads disposed on opposed sides of the frame. Each gripping pad has a non-elastomeric support layer with an elastomeric gripping layer molded thereon. The support layer of each gripping pad is provided with several extensions that are press fitted into mating elongated slots of the frame to provide the joint between the frame and each respective gripping pad. In consideration of the selection of a press fit joint over other suitable joining methods, one of skill in the art will understand that the retention or security of attachment properties of a typical press fit joint are dependent upon several characteristics of the joint including a property of many molded thermoplastics known as creep modulus and the provision a controlled difference in size, or interference, between the extension and one or both sides of its mating slot or opening. Creep modulus can be likened to a time-dependent relaxation effect which can cause the resistance to disengagement of a press fit joint to diminish over an extended time period. A controlled interference can provide a somewhat uniform assembly or insertion force of the press fitting parts and is preferred at least for manufacturing reasons.

So-called commodity thermoplastics of the olefin family such as polypropylene (PP) and derivatives of polyethylene (HDPE, LDPE etc) have desirous properties for a non-elastomeric support layer such as their ability to provide a secure chemical bond to some thermoplastic elastomer (TPE) gripping layers and their preferred ability to withstand chemical attack from some soaps and other shaving preparations. However the creep moduli of these materials is generally inferior to that of so-called engineering thermoplastics such as ABS, Polyoxymethylene (POM, commonly known as acetal) and other well known materials.

Other typical joining methods that might be considered by one of skill in the art include use of a snap fit joint. In one type of well known snap fit joint between two mating component parts, one component part is provided with an extension with a laterally extending protrusion, usually at or near the distal end portion of the extension. During assembly of the two parts the extension undergoes preferably elastic deformation as the lateral protrusion passes around a suitable shelf of the second part before snapping into a mating recess or void of the second part. As the deformation is preferably predominantly elastic, snap fit joints can be permanent or temporary, ie separable and reattachable. As the assembly of the two parts requires deformation of the extension, clearance is generally provided between the two parts to accommodate this deformation during relative motion of the two parts as these come together at assembly. One of skill in the art will understand that even if a snap fit joint is intended to be permanent it can be released if a force of appropriate magnitude and direction can be applied to the snap fit features. One of skill in the art will also understand that when a razor is accidentally dropped impact forces are generated that are generally unpredictable in magnitude, direction and transference through the razors structure and its component parts.

SUMMARY

The present invention has for its objective to eliminate, or at least substantially alleviate the limitations of the prior art by providing a handle for a safety razor having manufacturing advantages provided by an improved joint between a frame and a gripping pad of the handle.

An embodiment of a handle for a safety razor of the present invention includes an elongated hand gripping structure and a cartridge support structure at an end of the hand gripping structure. The elongated hand gripping structure includes a frame structure with at least one opening, a first gripping pad and a second gripping pad. Each gripping pad can preferably comprise a thermoplastic elastomeric outer gripping layer formed over a nonelastomeric thermoplastic support layer that is preferably polypropylene. The support layer of the first gripping pad has an extension having a snap fit protrusion at its distal end that cooperates with an opening of the frame to provide a snap fit joint between the frame and the first gripping pad. The second gripping pad has an extension that cooperates with the extension of the first gripping pad to prevent disengagement of the snap fit from the opening of the frame. Embodiments of the present invention include a first gripping pad having a bifurcated extension and the extension of the second gripping pad being partially received in the bifurcation.

The above features and advantages of the present invention will be more fully understood with reference to the following detailed description when taken in conjunction with the accompanying drawings.

DETAILED DESCRIPTION

Figure 2:
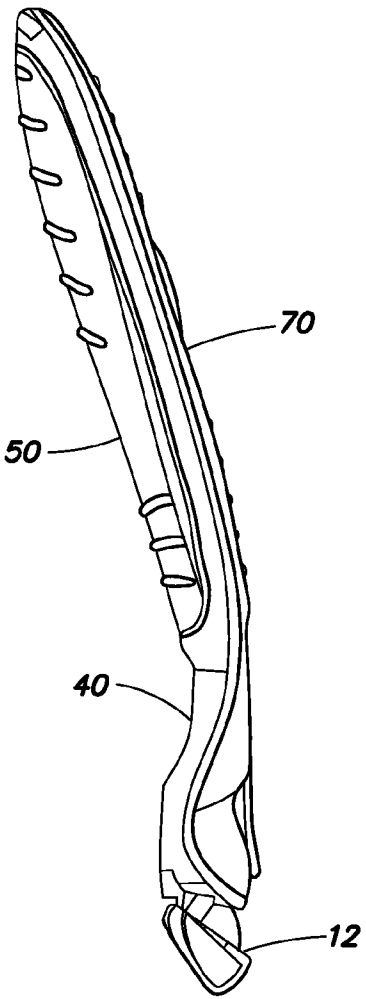
FIG. 2 is a side view of FIG. 1.
Figure 1:
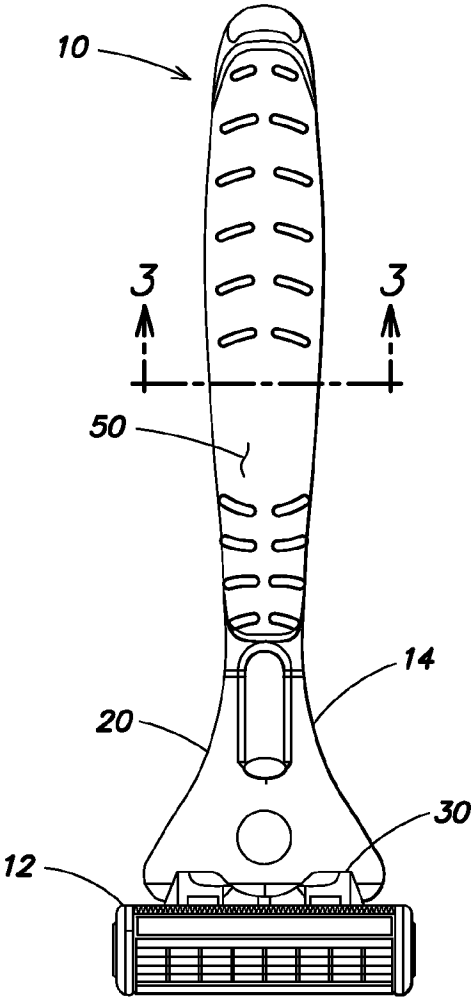
FIG. 1 is a front view of an embodiment of a safety razor of the present invention.

Referring now to the drawings and in particular FIGS. 1-2, a safety razor 10 is depicted that includes a razor cartridge 12 connected to a handle 14. The handle includes an elongated hand gripping structure 20 and a cartridge support structure 30. The cartridge support structure preferably provides connection to the razor cartridge such that a user may selectively replace the razor cartridge when he or she finds this appropriate. The cartridge is preferably pivotally connected to the support structure so that in use it can pivot about a pivot axis. Particular cartridge support structures including those having pivotal connection are well known to one of skill in the art and the present invention is not limited in this regard. The elongated hand gripping structure includes a frame 40, a first gripping pad 50 and a second gripping pad 70. The frame is preferably manufactured from a die-cast zinc alloy having a suitable metallic plating or painted surface as is well known in the art. The frame can also be manufactured from one or more injection molded components, manufactured from a suitable thermoplastic such as ABS or polyamide and the present invention is not limited in regard to the material or manufacture of the frame. Each gripping pad 50, 70 comprises an injection molded nonelastomeric support layer preferably manufactured from a commodity thermoplastic, more preferably polypropylene and most preferably the grade designated KPIC HJ4045 supplied by YUHWA. Each gripping pad preferably has a thermoplastic elastomeric (TPE) gripping layer molded over the support layer by any suitable and well known process such as multi-color, also known as multi-shot molding or insert molding. The TPE material is most preferably the grade designated VYRAM 9211-35W-906 supplied by AES. In the embodiment depicted in FIGS. 1 and 2 the gripping pads are shown disposed on the top and bottom of the hand gripping structure however these may equally be disposed on the left and right side of the hand gripping structure. In the embodiment depicted, two gripping pads are shown, however more than two gripping pads can equally be employed. For example the second gripping pad 70 could be replaced by two pads, preferably arranged sequentially along the frame and the present invention is not limited in this regard.

Figure 3A:
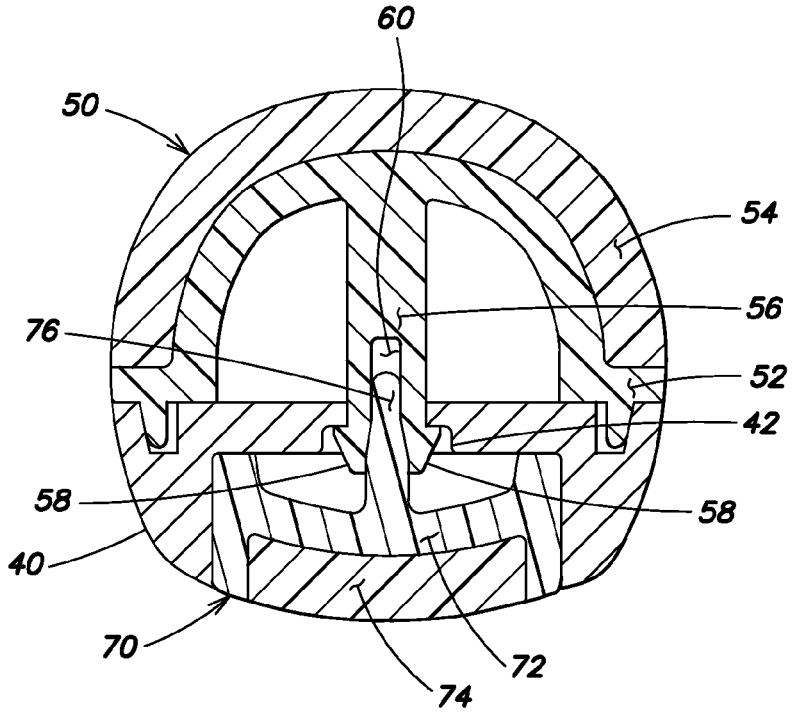
FIG. 3A is a sectional view taken along line 3-3 of FIG. 1.

Referring additionally now to FIG. 3A, a sectional view taken at the position of line 3-3 of FIG. 1 is depicted. The first gripping pad 50 comprises a support layer 52 and a gripping layer 54 as previously described. The second gripping pad 70 comprises a support layer 72 and a gripping layer 74 also as previously described. Frame 40 has an opening 42. The first gripping pad 50 has an extension 56, preferably bifurcated as depicted and having opposed protrusions 58 on the outer surface of the distal end portion of the extension. The bifurcation of the extension 56 provides an opening 60. The bifurcation of the extension preferably provides the distal end portions of the extension with sufficient elasticity to enable protrusions 58 to cooperate with the opening 42 of the frame to provide a well known snap fit joint thereby providing attachment between the frame 40 and the first gripping pad 50. The second gripping pad 70 is subsequently attached to the frame by any suitable and well known means such as by one or more snap fit joints, press fit joints or glue joints. The second gripping pad 70 has an extension 76 that at least partially extends into the bifurcation opening 60 of the extension of the first gripping pad. As extension 76 does not have to undergo deformation during assembly of the second gripping pad it is preferably provided with greater resistance to lateral deformation of its distal end portion than that of the distal end portion of the extension of the first gripping pad. In this manner, the extension of the second gripping pad 76 prevents disengagement of the snap fit joint of the first gripping pad from the frame. One of skill in the art will understand that a press fit joint may also be provided between the extension 76 of the second gripping pad and the opening 60 of the bifurcation of the first gripping pad to provide further security of attachment of each gripping pad to the frame and to each other. Although this disclosure only depicts a single sectional view of the handle of the safety razor taken at the position of line 3-3 of FIG. 1, one of skill in the art will understand that the group of cooperating features described previously can extend along the elongated hand gripping structure and can be a single group or multiple groups of cooperating features.

Figure 3B:
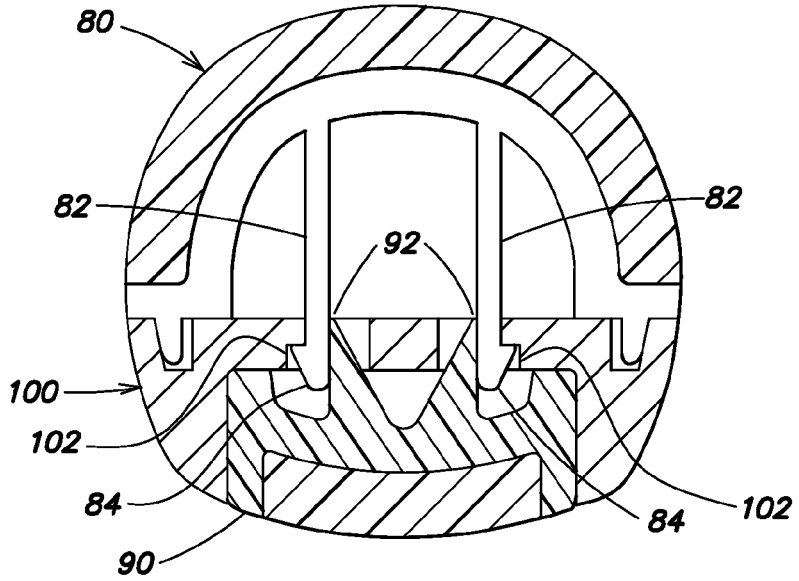
FIGS. 3B-3D are sectional views of further embodiments of the present invention taken along line 3-3 of FIG. 1.
Figure 3C:
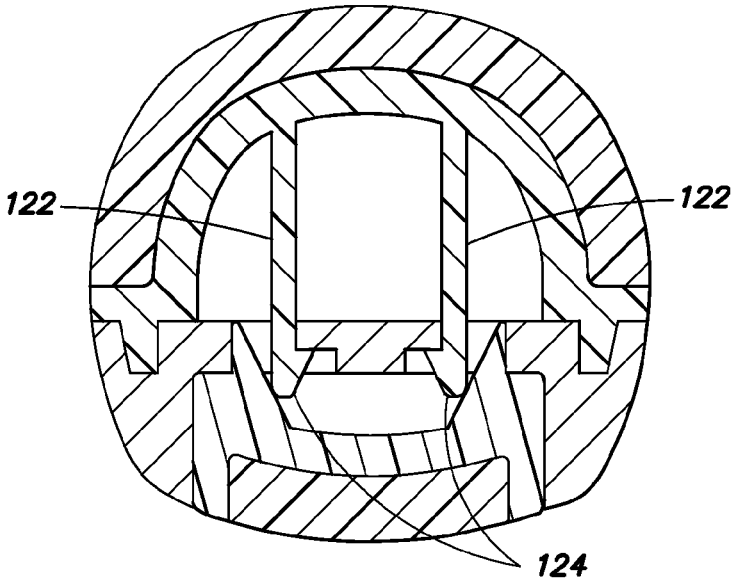
Figure 3D:
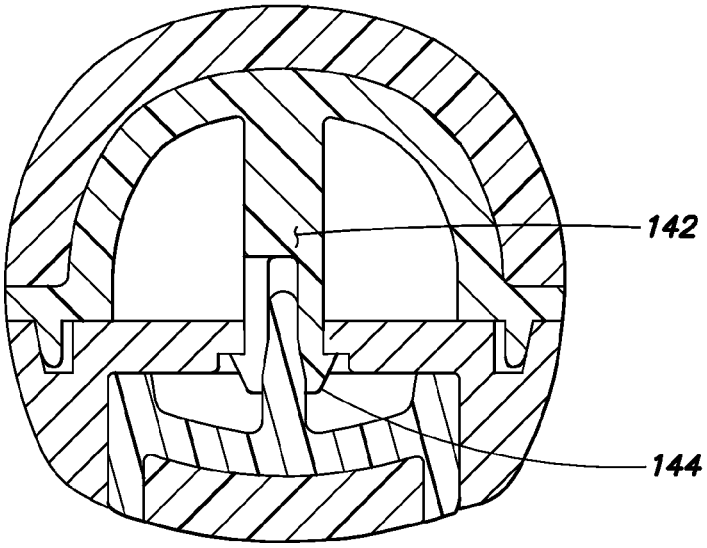

Referring now to FIGS. 3B-3D, alternative arrangements of extensions of the first and second gripping pad and cooperating frame opening(s) are depicted in a similar sectional view to that of FIG. 3A. In FIG. 3B extensions 82 of the first gripping pad 80 are depicted spaced apart across the width of the hand gripping structure. Extensions 82 each have a protrusion 84 on the outer surface of the distal end portion of the extension. Extensions 92 of the second gripping pad 90 cooperate with respective extensions of the first gripping pad to prevent disengagement of the snap fit joint between the first gripping pad and the frame 100, having openings 102 in cooperating relation with protrusions 84. FIG. 3C has a similar arrangement to FIG. 3B but with protrusions 124 being disposed on opposite sides of the distal end portions of the extensions 122 compared to the embodiment of FIG. 3B. FIG. 3D depicts protrusion 144 one side only of the centrally disposed extension 142 at the particular position of this sectional view. The protrusion can alternate between left and right sides of the extension (as depicted), as the extension extends along the frame of the elongated hand gripping structure.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. For instance, features disclosed in connection with any one embodiment can be used alone or in combination with each feature of the respective other embodiments.

What is claimed is:

1. A handle for a safety razor, comprising:

an elongated hand gripping structure, and a cartridge support structure at an end of the hand gripping structure, the elongated hand gripping structure including: a frame structure with at least one opening and a recess; a first gripping pad disposed on a first side of the frame and second side gripping pad disposed substantially within the recess on an opposed second side of the frame, the first gripping pad having at least a pair of extensions, each having a snap fit protrusion at a distal end portion thereof; each snap fit protrusion cooperating with the opening of the frame to provide a snap fit between the first gripping pad and the frame, and the second gripping pad having at least a pair of extensions, each extension disposed adjacent one of the extensions of the first gripping pad and at a side opposite the snap fit protrusion to prevent disengagement of the snap fit protrusion from the opening of the frame as a result of lateral deformation of the distal end portion of the extension of the first gripping pad.

2. The handle according to claim 1, wherein each gripping pad comprises a thermoplastic elastomeric outer gripping layer and a nonelastomeric thermoplastic support layer thereunder.

3. The handle according to claim 2, wherein the nonelastomeric thermoplastic support layer comprises polypropylene.

4. The handle according to claim 1, wherein the snap fit protrusions face one another.

5. The handle according to claim 1, wherein the snap fit protrusions face in opposed direction.

6. The handle according to claim 1, wherein the pair of extensions of the first gripping pad and the pair of extensions of the second gripping pad cooperate to provide a press fit joint therebetween.

* * * * *